United States Patent [19]

Lehman

[11] 4,409,997

[45] Oct. 18, 1983

[54] HINGED CIGARETTE EXTINGUISHER AND SAVER

[76] Inventor: James A. Lehman, 59 Reid Ter. (Apt. 14), Fond du Lac, Wis. 54935

[21] Appl. No.: 334,564

[22] Filed: Dec. 28, 1981

[51] Int. Cl.[3] ..... A24F 19/00; A24F 19/10; A24F 19/14; A24F 47/00

[52] U.S. Cl. ..... 131/235 ST; 131/237; 131/238

[58] Field of Search ..... 131/235 R, 235 ST, 237, 131/238

[56] References Cited

U.S. PATENT DOCUMENTS 1,806,782 5/1931 Brach ..... 131/235 ST

*Primary Examiner*—V. Millin

[57] ABSTRACT

The invention pertains to an improved cigarette snuffing implement which has a clamp to grip the sidewall of most vehicular, and some household, ashtrays, and a snuffer, comprised of split tube construction, having complementry sections, and a spring loaded hinge which pivotally attaches the sections. The split tube is open at both ends with one end terminating and secured, at the top of the clamp, and the other end positioned for the reception of cigarettes. An ejector arm is located within the split tube so that once the cigarette is deposited, and snuffed, the omplimentry body portions may be separated, and the cigaratte ejected to the bottom of the ashtray.

1 Claim, 7 Drawing Figures

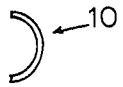
FIG. 1
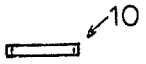
FIG. 2
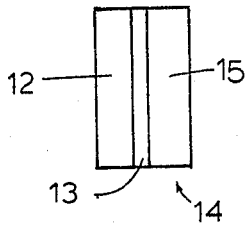
FIG. 3
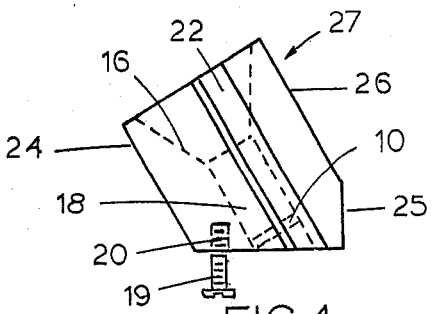
FIG. 4
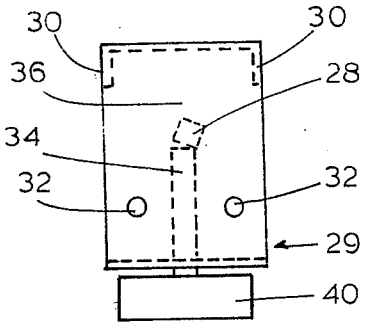
FIG. 5
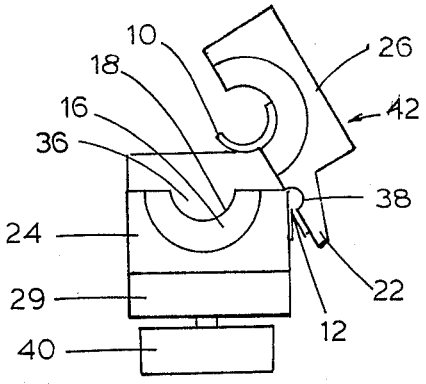
FIG. 6
FIG. 7
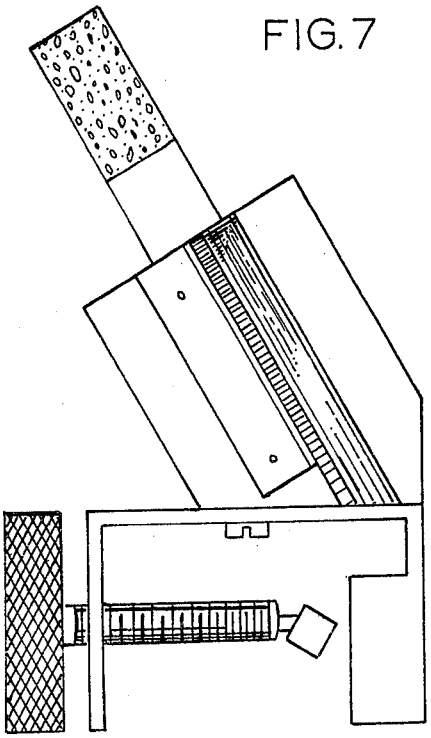

HINGED CIGARETTE EXTINGUISHER AND SAVER

CROSS REFERENCES TO RELATED INVENTIONS

The invention is a cigarette snuffing attachment which is an improvement and modification upon a cigarette snuffer developed by the inventor and for which a patent has been granted having U.S. Ser. No. 4,055,193.

BACKGROUND OF THE INVENTION

The present invention, in the field of cigarette snuffing devices, is similar to previous invention, U.S. Pat. No. 4,055,193, insofar as it has a clamp, a means to extinguish cigarettes, and a snuffing eyelet as its main components, and, in essence, it functions in a very similar fashion except the body of the new device, composed of complementry body portions with a split tub centered between them swings open to allow ejection of the cigarette where a stopper swung open to accomplish this with the old device. Certain problems inherent with shallow ashtrays, protruding dashboards, and odd shaped ashtray walls were discovered with the old device and resolved by the use of the present invention.

SUMMARY OF THE INVENTION

The instant invention overcomes the above deficiencies by utilizing the top of the clamp as the snuffing means which allows the lowest part of the extinguisher body to be no lower than the top surface of the clamp, this feature added to the ejection to the back feature, along the top of the clamp, allows the device to be used on very shallow ashtrays, which was not possible with the previous invention, which required an ashtray deep enough to allow a full length cigarette, in some instances, to have to drop its full length into the tray before it cleared the body of the extinguisher and could fall free to the bottom of the ashtray. The sixty degree angle of the device, toward the user, and away from the dashboard, in automotive applications, allows the split tube opening to be accessible regardless of the configuration of the dashboard above the ashtray, and the inward formed, downward extending opposed sidewalls opposite the clamp screw now allows the device to be attached to an ashtray wall of any shape because the clamp now clamps at three separate points and this triangulation effect lends itself to work well on any wall; which was not the case, always, with the previous clamp which allowed clamping between two points, only, in effect.

The present invention is far less complicated than the previous imbodiment in that it does not require an eyelet or bore in addition to the main bore or split tube or the paraphernalia which went into the second bore—such as the finger operated lever, casing, spring, link, and stopper—as with the previous invention, and as such the new device is simpler to manufacture, and cheaper, and longer lasting.

The present invention also has the advantage of being "self cleaning" to an extent, in that the ejector arm located near the bottom of the split tube cleans the ashes that may be deposited at the bottom of the split tube—doing this upon arcing back and forth.

Regarding the saver feature of this device it should be noted that cigarettes can easily be left in the device for days, if desired, and relit, and re-smoked thereafter since the cigarettes go out so fast when extinguished that little flavor is lost. As a result, many half-smoked cigarettes can be re-used which can save a smoker a considerable amount of money in time.

These, and other features and objects of the invention will be apparent to those familiar with this art as the description continues while being read in conjunction with the appended drawings.

BRIEF DESCRIPTION OF THE DRAWINGS

FIG. 1 is a top view of the ejector arm;

FIG. 2 is a side view of the ejector arm turned 90 degrees to the left;

FIG. 3 is a front view of the spring loaded hinge showing the arms extended out 180 degrees from each other and perpendicular to the knuckle of the hinge;

FIG. 4 shows a side view of the complementry body portions, the side view which shows the finger tab as part of one of the body portions;

FIG. 5 is a top view of the clamp assembly showing the clamp, the clamp screw, and the pad attached to the tip of the clamp screw;

FIG. 6 depicts the complete device as seen from the top showing the spring loaded hinge swung completely open, and the rear body portion and ejector arm swung out to the eject position;

FIG. 7 shows the invention from the finger tab side in a magnified view.

DESCRIPTION OF THE PREFERRED EMBODIMENT

The ejector arm is indicated by numeral 10 in FIGS. 1 and 2. This component is essentially a half washer or spacer with a thin wall section so as not to interfere with the deposit of a cigarette in the area at the bottom of the split tube 18 where the tip of the deposited cigarette meets the ejector arm—refer to FIG. 4.

The attachment means for attaching the complementry body portions, forward body portion 24, and rearward body portion 26—refer to FIG. 4—is a spring loaded hinge 14 which is spot welded with hinge arm 12 being welded to body portion 24, and hinge arm 15 being welded to body portion 26; more will be explained about this operation when describing FIG. 6. The spring loaded knuckle of the hinge 13, completes the elements shown in FIG. 3.

FIG. 4 is made up of the two complementry body portions, 24 and 26, ejector arm 10, split tube, open at both ends, 18, flaired top portion of the split tube 16, finger tab 22, two threaded holes 20—which are in line, one behind the other thus only one hole can be seen—and elements 32, which are clearance holes for screw 19 which goes through the clamp shown in FIG. 5 and into the forward body portion 24 shown in FIG. 4 to make up the body/clamp assembly. Also shown is the blunted nose 25 of the rearward body portion which has been blunted for purposes of appearance, and also for good engineering since if it were not blunted it may make contact with some dashboards while the device is in operation. Numeral 27 refers to all of the elements of FIG. 4, as a whole assembly, less the hinge, which could not be shown without making a jumble of lines.

FIG. 5 shows the clamp assembly 29 which is entirely made of stainless steel, but can be made of other materials, except for the screw pad, which is made of plastic. Elements 32 are clearance holes described previously. Elements 30, a pair of downward extending opposed sidewalls allow clamping through triangulation with the screw tip so that odd shaped ashtray walls can be clamped when the inverted U-shape clamp is placed over such walls. Element 34 is the threaded portion of the knurled head of the toggle screw 40, a thumb screw or any such screw may be substituted in its place however. Design feature 36, the snuffing area, so to speak, is located on top of the clamp, where the cigarette comes to rest after being deposited into the body portions; which are not shown here.

FIG. 6 shows the complete Cigarette Extinguisher and Saver assembly 42 seen from the preferred position as it would be clamped relative to the user and shows the rearward body portion 26 arced out to its eject position approximately some seventy degrees away. The cigarette when pushed across the top of the clamp toward its end easily drops out of the body, and off the clamp, when ejected thus, especially since the body is positioned 60 degrees, approximately, relative to the top surface of the clamp 29.

Element 36, the snuffing area, is where the cigarette is extinguished after being deposited into the complementry body portions when they are in the closed position. A cigarette deposited thus is shut off from oxygen at its tip, and at its sides, and to a great extent at its rear since the split tube is of a considerable length, and small enough in diameter to cause this to happen.

To eject the cigarette the user presses finger tab 22, which is positioned on body portion 26, and presses until the hinge arms come in contact, at which the ejector arm 10, pushes the cigarette out of the split tube and off the clamp.

It should be noted that a groove 38 has been milled or molded into the rearward body portion so that the hinge knuckle may be inserted there so as to produce the best possible alingment between the complementry body portions. The groove is not absolutely necessary but it does facilitate manufacturing, and improve performance.

Additionally, the flaired portion 16, of the split tube 18 is not absolutely necessary, but it does help to facilitate the aiming of the cigarette toward the split tube by providing a sort of a bullseye, and by making the insertion of the cigarette into the split tube easier.

Many changes may be made in detail of the instant invention, in the method of manufacturing, in the configuration and assemblage of the constituent elements, without departing in the spirit and scope of the appended claims, which changes are intended to be embraced therewithin.

Having thus described the invention, what is claimed as new and useful and desired to be secured by United States Letters Patent is:

1. A cigarette snuffer in combination with a clamping means; said snuffer comprising a split tube construction have complimentry sections wherein a hinge pivotally attaches said sections; said clamping means comprising an inverted U-shape construction having a substantially flat upper surface and two downwardly extending and opposed sidewalls wherein said sidewalls include a pair of opposed resilient gripping elements; means for compressing one of said gripping elements against the other of said gripping elements so as to grip a substantially vertical wall type support; said split tube construction being open at both ends having one end terminating on a portion of said upper surface of said clamp making said portion the terminating end and the other end positioned for the reception of cigarettes to be snuffed; a means for ejecting said cigraette located within said split tube and attached to one of said complimentry sections so as to eject the snuffed cigarette when the complimentry sections are separated an effective number of degrees.

* * * * *